US009303877B2

(12) United States Patent
Parson

(10) Patent No.: US 9,303,877 B2
(45) Date of Patent: Apr. 5, 2016

(54) FAUX CANDLE FIREPLACE INSERT WITH HEATING CAPACITY

(76) Inventor: Mark Wesley Parson, Pinehurst, NC (US)

( * ) Notice: Subject to any disclaimer, the term of this patent is extended or adjusted under 35 U.S.C. 154(b) by 824 days.

(21) Appl. No.: 13/238,052

(22) Filed: Sep. 21, 2011

(65) Prior Publication Data

US 2013/0071798 A1 Mar. 21, 2013

(51) Int. Cl.

| | |
|---|---|
| ***F23Q 2/32*** | (2006.01) |
| ***F23D 14/62*** | (2006.01) |
| ***F24B 1/18*** | (2006.01) |
| ***F24C 3/00*** | (2006.01) |
| ***F24B 1/191*** | (2006.01) |
| ***F21V 37/00*** | (2006.01) |
| ***F23D 14/28*** | (2006.01) |

(52) U.S. Cl.

CPC ..... *F24C 3/006* (2013.01); *F21V 37/00* (2013.01); *F23D 14/28* (2013.01); *F24B 1/191* (2013.01)

(58) Field of Classification Search

CPC ..... F24B 1/191; F24C 3/006; F21V 37/00; F23D 14/28

USPC ..... 431/125, 354, 355; 126/512

See application file for complete search history.

(56) References Cited

U.S. PATENT DOCUMENTS

| | | | | |
|---|---|---|---|---|
| 2,671,440 | A * | 3/1954 | Dupler | F24B 1/1808 126/512 |
| 3,358,474 | A | 12/1967 | Liesse | |
| 6,884,063 | B2 * | 4/2005 | Wong | 431/255 |
| 2004/0089289 | A1 | 5/2004 | Tingley | |

FOREIGN PATENT DOCUMENTS

| | | | | |
|---|---|---|---|---|
| GB | 1238484 | * | 7/1971 | F23D 13/24 |

* cited by examiner

*Primary Examiner* — William G Corboy

(74) *Attorney, Agent, or Firm* — James G. Passé; Passé Intellectual Property, LLC

(57) ABSTRACT

The present invention relates to a fireplace insert for a gas fireplace wherein the traditional gas fireplace logs are replaced by faux candles with gas flame wicks wherein at least one candle has a heating element, besides the wicks, in the body of the candle to produce heat from the fireplace.

5 Claims, 3 Drawing Sheets

FAUX CANDLE FIREPLACE INSERT WITH HEATING CAPACITY

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to a fireplace insert for replacing the gas fireplace logs. In particular, it relates to a gas faux candle or candles for use in a fireplace which in addition to lighting like a candle, provides a heating element to heat the room or area served by the fireplace.

2. Description of Related Art

It has become common practice to place candles inside a fireplace instead of logs. They provide an old fashioned feeling and a sense of an intimate atmosphere. One or more candles are decoratively arranged and then in intimate moments lit to provide an entirely different mood than burning logs.

Many people have gas fireplaces and in such cases it is not possible to regularly take out gas fireplace logs in order to replace them with candles as can be done with a wood burning fireplace. One thing that has been developed as early as 1966, is the use of a faux candle which has a gas lit candle flame at the candle top simulating a burning candle. One or more are placed decoratively in the fireplace as a replacement to gas fireplace logs since a gas connection and electric spark lighters are utilized. In U.S. Pat. No. 3,358,474 to Liesse, filed Mar. 16, 1966, there is disclosed space lighting fittings comprising one or more faux candles which automatically lights upon use of an ignition source in the candle. More recently in U.S. application Ser. No. 10/688,512 to Tingley there is disclosed a modular gas fueled assembly for placement of a plurality of faux candles mounted on a fireplace insert. Like the previous patent, they provide a gas fueled light at the top of the faux candle to provide a lit candle like appearance.

However, when one chooses to place faux gas candles into a fireplace one gives up the ability to utilize the fireplace to heat the space utilized by the fireplace in exchange for the decorative aspect of candles. This is because the installation of gas candles means that the gas logs originally utilized with such a fireplace have been removed. Choice has been decoration or heat. Even though this technology has been utilized for closing in on 50 years this "either or" choice has remained.

BRIEF SUMMARY OF THE INVENTION

The present invention solves the problems identified above by including in the faux candles arranged in a gas fireplace at least one of the candles which has a heating element built into the body of the candle positioned to face away from the front of the fireplace (facing the rear of the fireplace) such that heat can be provided while still maintaining the artistic aspects of having faux gas candles in the fireplace.

In one embodiment the invention is a gas fireplace insert for utilizing in a fireplace having a gas connection, the insert having one or more faux candles which have a front facing side and a back facing side, and having a gas lit candle flame wherein the insert comprises at least one of the one or more faux gas candles, having positioned on the back facing side of the one or more candles a gas lit heating element for providing heat from the fireplace.

In another embodiment the invention is a faux candle having a front side and a back side and having a gas lit candle flame comprising a heating element position on the back side of the candle.

DETAILED DESCRIPTION OF THE INVENTION

Figure 1:
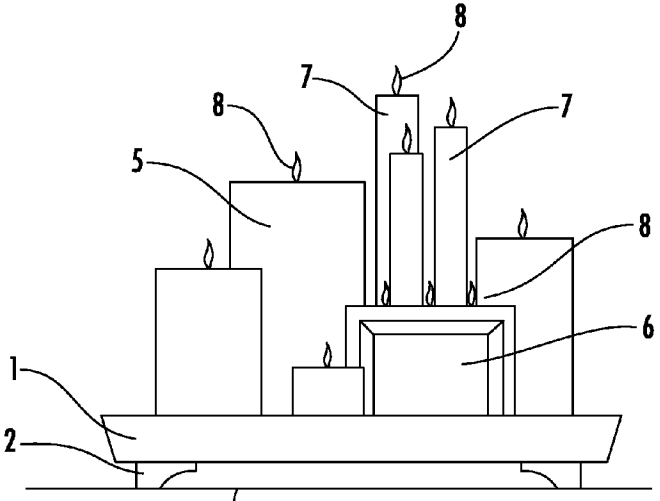
FIG. 1 is a front view of a gas fireplace insert.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The terms "substantially and "about" as used herein, mean±10 percent.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto.

Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "gas fireplace insert" refers to a device for placement in a chimney firebox of a home or commercial chimney/fireplace that is equipped with a natural, propane, or the like heating gas fuel attachment connection. The attachment would normally be designed for gas fireplace logs. Accordingly, the insert refers to a device which can be placed in the firebox area and have appropriate tubing and fittings for attaching to the fireplace gas supply and fit within the area designed for safe placement of gas fireplace logs or the like. The device has a frame portion which is resistant to the heat involved and can be used to position the faux candles of the present invention. While normally such units have a rectangular construction to meet the size and shape of the firebox floor area, other shapes can be fashioned. The basic frame for candles of the prior art, such as disclosed above, could be adapted with the candles of the present invention so essentially the basic frame of this type of device is within the skill in the art.

As used herein a "faux candle" refers to a device which resembles a real wax candle or any look or device that has the appearance of a burning wick and is outfitted and designed to have a candle flame which is supplied by gas from the gas connection. Optionally, an automatic gas lighting device/ignition device can be used to light the candle or candles. In one embodiment, the faux candle can be lit by match or other flame or spark device either hand or automatic. Candles will have a front side which faces outward and is essentially the only part of the candle that can be seen looking at the candle mounted on the fireplace insert as it sits in the firebox area. The candle has a back facing side which is the side opposite the front facing side which is difficult or impossible to see because it faces toward the back of the firebox. A fireplace insert may have one or more faux candles positioned on the insert in a decorative pattern. The candles may be any size, shape, height, or width associated with candles where they are all the same or different size or shape and they all fit on the fireplace insert and fit within the desired firebox. The candles may be mounted directly on the insert frame itself or may have a candle holder type device for holding one or more of the candles. Candles may have one or more wicks as well since many real candles, especially wide ones, have multiple wicks on them.

The present invention candles have, in addition to the above attributes, positioned on the back facing side of the candle a gas lit heating element of sufficient heating capacity to provide heat from the fireplace (out the firebox as would gas fireplace logs). Heating elements that are gas fired include, but are not limited to, gas flare heaters (such as luminous high intensity and radiant tube types). There can be a single candle of the invention or multiple candles of the invention and they can be mixed with faux candles that do not have a heating element. While the size of the heating element is limited to some extent by the size of the candle, as would be obvious from the disclosure, heating elements of a gas design are well known in the art and they can be adapted to what would generally be a rectangular shape with a portion fitting in the candle. The element could be rounded to continue the candle design or flat as most heating elements are and since the back is not viewable, it will not deter the view of the decorative aspects of the faux candles. Even though such heating elements are well known in the art and even though faux candles without heating elements on their back facing side are known, they have never been combined with faux candles to date. The candle flame herein by our definition is not a heating element, though it clearly provides heat. Of course, the flame is on the top of the candle and the heating element of the present invention is positioned on the side of the candle. The typical BTU's of such heating elements would be from about 5,000 BTU to about 40,000 BTU output. In addition, a fireplace fan could be added to the fireplace insert unit or within the firebox to aid in its heating effects by blowing hot air from the firebox to the surrounding environment. One skilled in the art could easily pair and position such a fan in view of the present invention and disclosure. In another embodiment a candle of the invention can have two or more heating elements facing the back side of the faux candle.

In one embodiment of the invention the faux candles turn on as a unit, that is the candle flame and the candle heating unit are all either on or off. In another embodiment the heating elements can be turned off separately from the candle flame or at least can be adjusted separately from the flame. It some embodiments the candles can all be lit without the heating feature. Adjusting the intensity of the heating element and the candle flame, either separate or together, is within the skill of the art in view of the present disclosure and what is known about heating elements and faux candles in general. In another embodiment the candles are adapted to be quick release/install. As used herein "quick release" refers to connection that can be done with little or no tools in a few seconds rather than the type that requires tools, bolting and unbolting, and the like or otherwise a permanent installation. Connections can be, for example, by snaps, hand tighten screws, twist, self-lock, and the like.

The gas fireplace insert can be installed as part of a new fireplace installation or can be utilized to replace an existing gas insert of any kind not of the invention. The installation of the unit can be by any means and one skilled in the art of gas installation would be able to manage the installation of a unit in view of the present disclosure.

Now referring to the drawings, FIG. 1 is a front view of the present invention. Gas fireplace insert 1 having feet 2 sits on firebox floor 3 of a fireplace. A number of different sizes and heights of faux candles can be seen. Since it is a front view, any heating elements which face the other (rear) side are not visible. Candle 5 is a fat candle, candle 6 a candle with three wicks, and candles 7 are tall candles. Other varieties of candles can obviously be made in view of this disclosure. Each candle has wick with flame 8.

Figure 2:
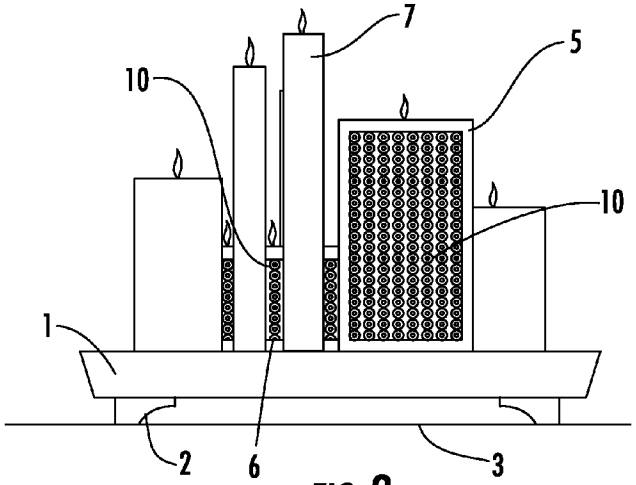
FIG. 2 is a back view of a fireplace insert.

In FIG. 2 we see a rear view of the present invention. In this view we can see that only candles 5 and 6 have heater 10 on the back side of the candle and these are the candles of the present invention. They are mixed with regular faux candles 7 which have no heating element in the back facing side. In this view the heating element 10 is essentially the entire back side of the candles 5 and 6 though they could be smaller.

Figure 3:
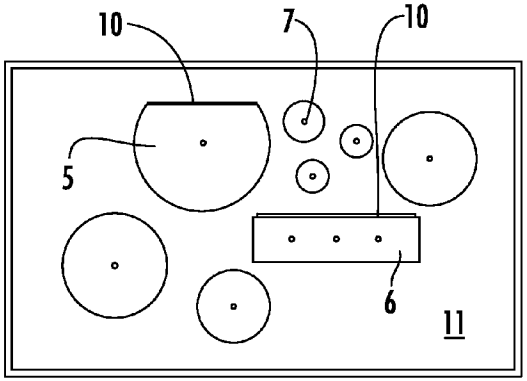
FIG. 3 is a top view of a fireplace insert.

FIG. 3 is a top view of the invention to show a more three dimensional relationship of the candles of the invention 5 and 6. It can be noted in this embodiment the back side of candles 5 and 6 is flat as opposed to the rounded back sides of the remaining candles such as candle 7. Candles all sit on fireplace inset platform 11.

Figure 4:
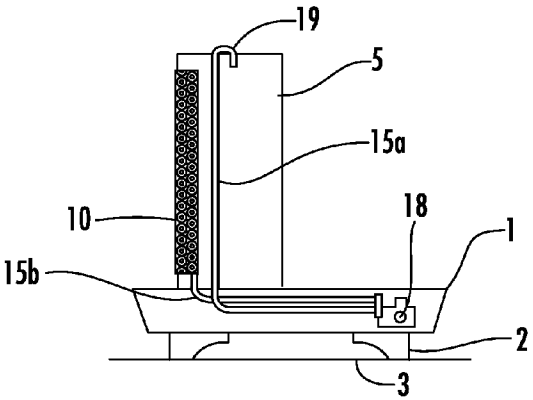
FIG. 4 is a side view of a fireplace insert.
Figure 5:
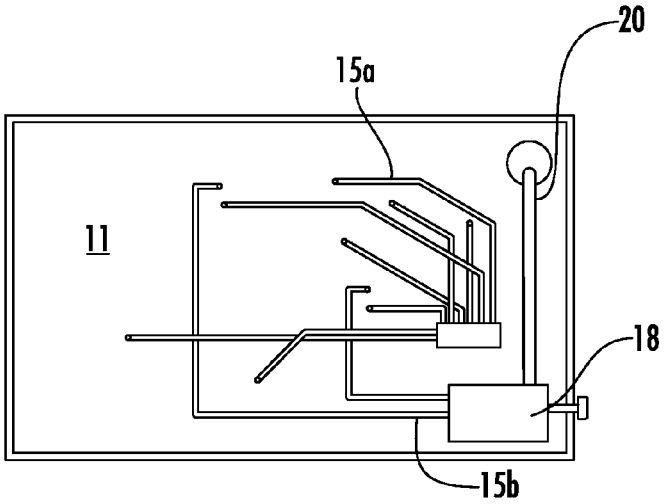
FIG. 5 is a tubing arrangement for the candles depicting in FIG. 1.

In FIG. 4 there is a single candle of the invention in side view with a see through aspect of the insert 1, and the candle. The gas lines 15*a* and 15*b* to the flame 8 and heater 10 are shown in cut through view. In addition, gas control 18 is shown which can control both/either the flame 8 or the heater 10. An automatic flame lighter 19 is also shown. FIG. 5 shows a top view of gas lines 15*a* and 15*b* without the candles of the invention in place. The connection to the gas line 20 can be seen in this view.

Figure 6:
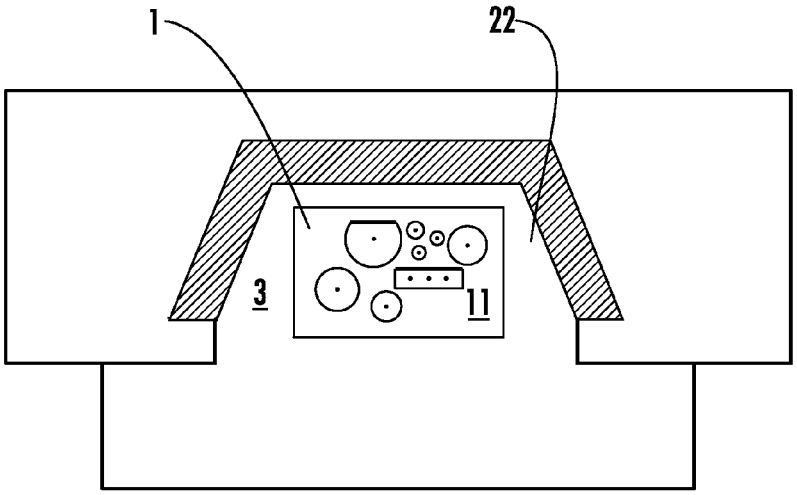
FIG. 6 is a top view of the fireplace insert positioned in a fireplace.

In FIG. 6 the gas fireplace insert 1 of the present invention is shown facing forward of a fireplace box 22 and sitting on firebox floor 3. The gas fireplace insert 1 is shown in the same view as FIG. 3.

Figure 7:
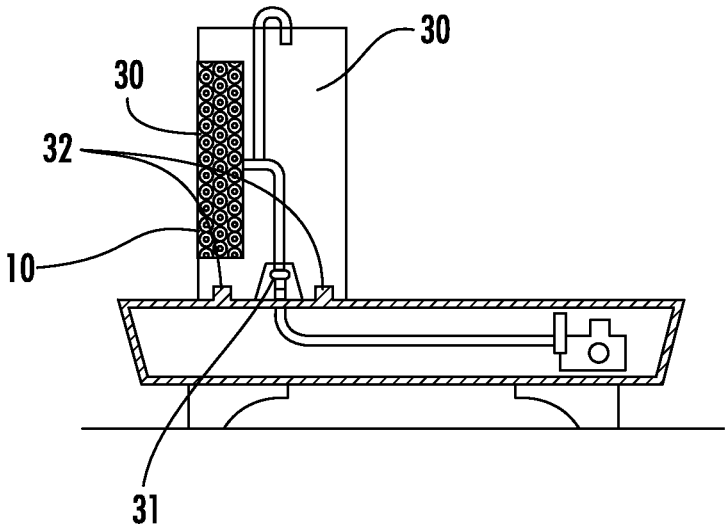
FIG. 7 is a side view of a replaceable candle (quick release).

In FIG. 7 a quick release candle 30 is depicted in a side view. The candle has gas connection 31 and plate connection 32. Each connector can be done in moments to change the candle to a different one or a replacement.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A gas fireplace insert for utilizing in a fireplace having a gas connection, the insert having a plurality of faux candles which have a front face and a back face and having a gas lit candle flame wherein the insert comprises at least one of the plurality of faux gas candles having positioned on the back face of the at least one of the plurality of faux gas candles a backward facing gas lit heater having a heat output of at least 5,000 BTU for providing heat from the fireplace in addition to and at the same time as the heat provided by the plurality of faux gas candles; and a gas control unit that controls both the backward facing gas lit heater and the gas lit candle flame, wherein the gas control unit controls the backward facing gas lit heater independent of the gas lit candle flame.

2. The gas fireplace insert of claim 1 wherein the backward facing gas lit heater is adjustable in intensity.

3. The gas fireplace insert of claim 1 wherein there are a plurality of gas lit candles having a backward facing gas lit heater on the back side.

4. The gas fireplace insert of claim 1 wherein the backward facing gas lit heater has a heat output of from at least 5,000 to 40,000 BTU.

5. The gas fireplace insert according to claim 1 wherein at least one of the plurality of faux gas candles has a quick connect gas connection.

* * * * *